US010028046B1

(12) United States Patent
Rolf

(10) Patent No.: US 10,028,046 B1
(45) **Date of Patent: *Jul. 17, 2018**

(54) WIRELESS SPEAKER AND LAMP

(71) Applicant: glori, llc, Kansas City, MO (US)

(72) Inventor: Devon A. Rolf, Overland Park, KS (US)

(73) Assignee: glori, llc, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/790,503

(22) Filed: Oct. 23, 2017

Related U.S. Application Data

(63) Continuation of application No. 14/726,059, filed on May 29, 2015, now Pat. No. 9,820,024.

(60) Provisional application No. 61/997,394, filed on May 31, 2014.

(51) Int. Cl.
*H04R 1/02* (2006.01)
*F21V 33/00* (2006.01)

(52) U.S. Cl.
CPC ..... *H04R 1/028* (2013.01); *F21V 33/0056* (2013.01); *H04R 2420/07* (2013.01)

(58) Field of Classification Search
CPC .. H04R 1/028; H04R 2420/07; F21V 33/0056
USPC ..... 381/388
See application file for complete search history.

(56) References Cited

U.S. PATENT DOCUMENTS 8,284,978 B1 * 10/2012 Strauser ..... G10H 1/361 381/365
2003/0235320 A1 * 12/2003 Hirschhorn ..... F16M 11/041 381/333
2006/0209530 A1 * 9/2006 Schaak ..... F21S 6/003 362/86
2009/0067663 A1 * 3/2009 Ivey ..... F21V 7/0008 381/386
2012/0300962 A1 * 11/2012 Devoto ..... H04R 5/02 381/300
2015/0016114 A1 * 1/2015 Marquardt ..... F21V 21/26 362/253

* cited by examiner

*Primary Examiner* — Sean H Nguyen
(74) *Attorney, Agent, or Firm* — Erickson Kernell IP, LLC

(57) ABSTRACT

A speaker system and lamp has a base and a pedestal rotationally mounted and extending upwardly from the base. A speaker housing is rotatably mounted to the pedestal. A speaker is positioned inside the speaker housing and audibly outputs music that is received by the speaker system. A lamp assembly is fixedly mounted to a top or upper portion of the pedestal above the speaker housing. An amplifier is located in the base and connects by cabling extending through the pedestal to the speaker. A wireless receiver is located in the base or speaker housing. A floor standing speaker system and lamp includes multiple speaker components, including a subwoofer in a portion of the base and multiple speakers mounted to the pedestal. Optional removable components such as a mirror, a vinyl record display, artwork, a clock, or a directional light are available for removably mounting to the pedestal.

7 Claims, 12 Drawing Sheets

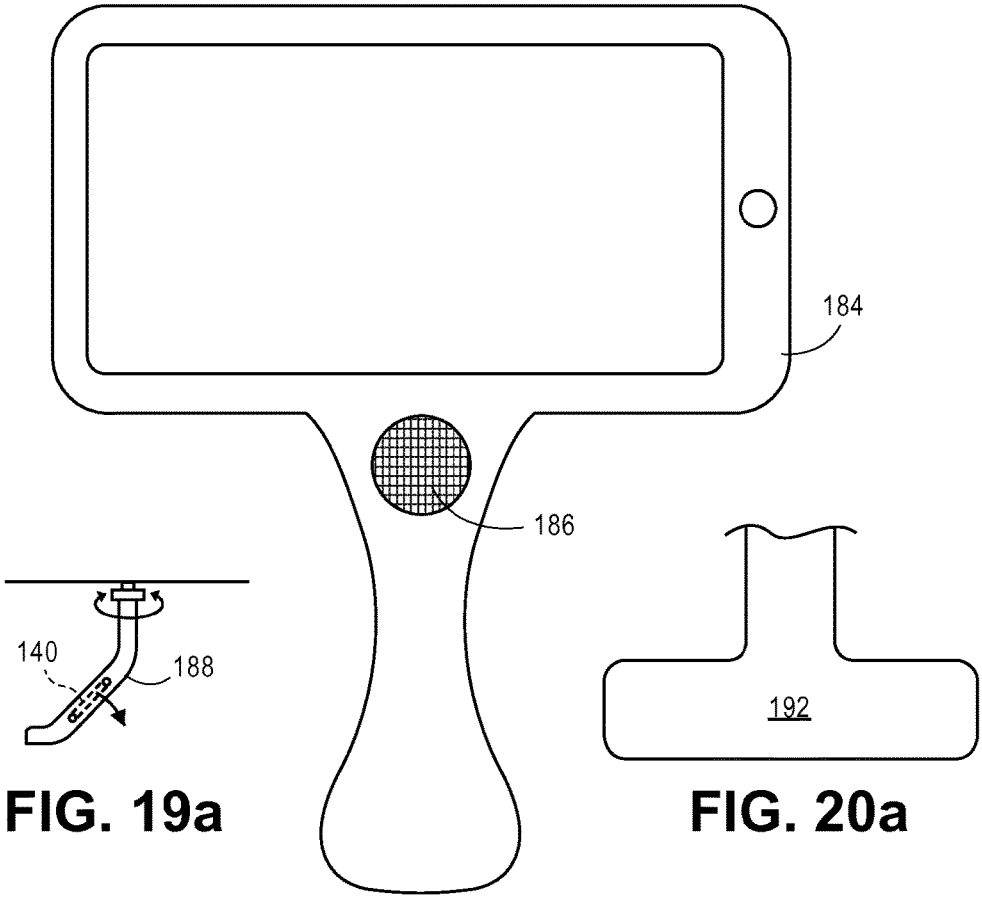
FIG. 19a
FIG. 20a
FIG. 19
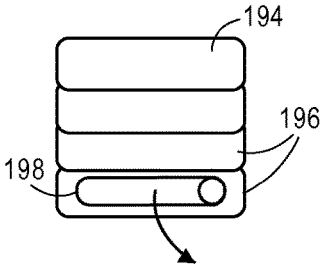
FIG. 22
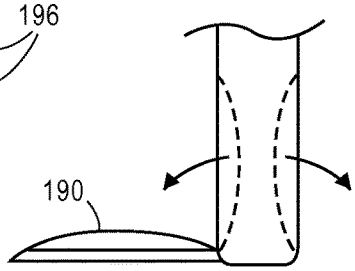
FIG. 21
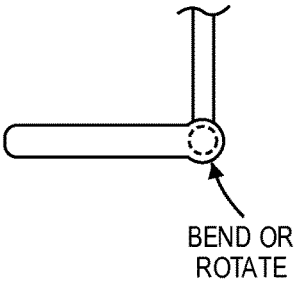
FIG. 20b

WIRELESS SPEAKER AND LAMP

RELATED APPLICATIONS

This application is a continuation, claiming priority benefit with regard to all common subject matter, of earlier-filed U.S. patent application Ser. No. 14/726,059, filed May 29, 2015, entitled "WIRELESS SPEAKER AND LAMP" (the '059 Application). The '059 Application is a non-provisional application, claiming priority benefit with regard to all common subject matter, of earlier-filed U.S. Provisional Patent Application Ser. No. 61/997,394, filed May 31, 2014, and entitled "WIRELESS SPEAKER SYSTEM AND METHOD OF DISTRIBUTING RECORDS" (the '394 Application). The identified earlier-filed patent applications are hereby incorporated by reference in their entirety into the present application.

BACKGROUND OF THE INVENTION

The present invention is generally directed to a speaker system. More particularly, the present invention is directed to a wireless speaker system. More specifically, the present invention is directed to a wireless speaker system that incorporates a vinyl record or album having at least one music recording cut or pressed into the record or album.

Wireless speaker systems that receive a streaming music signal from a streaming audio source are known. Such systems may utilize one or more of wi-fi and/or Bluetooth for receiving audio signals from a source. Some speaker systems employ proprietary protocols, such as Apple Corp.'s AirPlay. Some existing wireless speaker products are certified to use the Digital Living Network Alliance (DLNA) standard.

Phonograph disc records, typically made of vinyl, were tremendously popular in the $20^{th}$ century, but quickly waned in popularity in the last quarter of that century as they were replaced by digital media in the form of a compact disc. More recently, compact disc sales dropped as customers began downloading and streaming digital music files to personal computers and portable music players. Nevertheless, in addition to being important historically, vinyl record use and production remains a niche marketplace for enthusiasts and audiophiles. Additionally, vinyl records provide an opportunity for visual artistry that is not present with a digital music file.

SUMMARY OF THE INVENTION

The present invention is a speaker system that incorporates an enclosure, such as a housing or a cabinet, one or more speaker drivers and a vinyl record, such as a round vinyl disc with a label. The vinyl record is mounted for display at one side of the housing (such as a front face) and is removable from the housing as described herein. Different embodiments of the present invention may incorporate different sized vinyl records. Preferred examples include use of vinyl records that are 12 inches in diameter and 10 inches in diameter (such as conventional Long Play (LP) records manufactured for play at 33½ revolutions per minute (RPMs)), and 7 inches in diameter (such as conventional "45" records manufactured for play at 45 RPMs). However, other, custom sized records can be produced for use with the present invention.

In particular, in embodiments of the invention, a square or rectangular housing mounts a plurality of speaker drivers behind a mesh or screen, with each speaker driver being proximate one corner of the housing and the displayed record being in the center. In other embodiments of the invention, a displayed record is centered on a front face of a round housing with speakers being mounted in the housing in a rear-facing manner so as to emit sound from a rear face of the round housing. As described herein, the housing and/or the pedestal on which it stands may be rotational so that it can be positioned by the user in the manner desired. The pedestal may include a lamp for providing light to a room or surrounding environment.

In another embodiment, similar to the embodiment just described, a portable digital music player having a touch screen display, such as a tablet, digital music player, or cell phone, is mounted in the housing so that its display is viewable and accessible. By way of an example, an Apple iPad is mounted in the housing above the record and speakers so that its display (and home button) is accessible at an opening in the front face of the housing and its power port is accessible via an opening in the side of the housing.

The embodiments of the present invention just described can include decorative framing (such as a frame made of wood, metal, plastic, carbon fiber, glass, or other material). Embodiments of the invention can include one or more lamps to provide light for decoration, light for functional feedback (such as lighting a portion of a ring, or increasing or decreasing light intensity, proportionally with the volume of the speakers), and light for lighting a room or a surrounding environment.

Embodiments of the invention may employ a single speaker, but preferably the present invention is a speaker system that employs a plurality of speakers, including one or more of low-range, mid-range, and high-range speaker drivers. In particular, different transducers (speaker drivers) for amplifying and outputting different audio frequency ranges are used. For example, the speaker system of the invention may employ one or more of subwoofers, woofers, mid-range drivers, tweeters, and supertweeters.

Speakers are mounted in the housing in the desired location and facing the desired direction, such as on a constructed or molded mounting frame. The invention may position speakers in only a forward facing manner, only a rear facing manner, or both forward and rear facing manners. Embodiments include mounting a rear facing subwoofer in the housing. One or more speaker grills and/or speaker cloth or mesh is used on the speakers or on the speaker housing to enable sound to be effectively emitted. According to a particular aspect of the invention, one or more wave guides are used to direct sound, that is output from a rear (or downward) facing speaker (such as a subwoofer) when the product of the invention is resting on or mounted to a surface, to a front or outer face of the product. In particular, one or more wave guides are used to direct sound out of a ring that surrounds the record presented for display by the wireless speaker system of the present invention.

In another embodiment of the invention, the record (which is round) is mounted for display on the front face of a round speaker housing. In one such embodiment, the invention includes at least rear facing speaker drivers and the round housing is mounted on a pedestal that enables the housing to be rotated about an axis. For example, the pedestal may enable the round housing to rotate about a horizontal axis, while the pedestal itself rotates about a vertical axis. A base of the pedestal has small feet portions (separating raised side portions) and a raised central bottom portion and houses a downward facing subwoofer.

Embodiments of the invention may include one or more lights, including but not limited to back lighting that illuminates a ring surrounding the periphery of the mounted record. Embodiments include producing the record of a clear or semi-clear material, such as transparent plastic, such that light passes through the record. Embodiments of the present invention include lamps.

The present invention may employ AC power, such as via a plug plugged into an AC power outlet. The present invention may employ battery power and may employ a rechargeable battery and AC/DC adapter. Powering wireless speakers is well-known and the present invention employs conventional techniques for providing power to the speakers and other electrical components of the invention (such as bulbs for light, a motor to rotate the turntable, etc.).

In addition to conventional speakers components (transducers, amplifiers, etc.), the invention includes electrical components, such as an electronic processor, a memory, a transmitter/receiver that operates on the Bluetooth® protocol, a transmitter and receiver for communicating with other devices via a wireless local area network, a power supply, a power on-off button and switch, one or more inputs (such as speaker control, volume control, etc.), clockworks, an RFID and/or NFC reader, and a rotary motor for rotating a turntable component.

Computer software, having a set of executable instructions stored on a computer readable medium, is executed to perform methods and functions and to enable methods and functions of the present invention, including but not limited to—pairing the speaker system with a source of digital media, wirelessly receiving and audibly outputting media, detecting the identity of one or more music recordings on a record displayed on the speaker system housing, detecting the identity of a music recording that is wirelessly received by the speaker system, comparing the identity of the received music recording with an identified music recording on the record, executing an instruction to cause one or more outputs (such as controlling one or more lamps, rotating a turntable component, and/or moving a stylus) when the identity of a received music recording matches the identity of a song on the record, muting speakers in a tablet or disabling an audio feature (such as AirPlay®) in a tablet used in the housing of the speaker system.

In accordance with an aspect of the invention, and particularly useful in embodiments of the invention in which the speaker system of the present invention is wall-mounted and uses a power cord plugged into an outlet that is located near the bottom of the wall or on the floor, headphones or earbuds having a cord are located so that the earphones or earbuds are positioned on opposite sides of the record. The cord to the earphones or earbuds dangles to the bottom of the unit where it is banded together by a binding with the power cord, which hangs down the wall to the outlet. This creates an interesting visual effect that is consistent with use of headphones or earbuds, since headphones or earbuds (when not wireless) have one or more cords hanging to the user's music player.

According to an aspect of the invention, a record of seven inches in diameter is provided with a round center hole having a diameter that is different than the diameter of center holes in conventional 7 inch records. In particular, the center hole of the record according to the present invention preferably has a diameter that is greater than 1.5 inches, such as 1.6 inches, 1.7 inches, 1.75 inches, 1.8 inches, 1.9 inches, or 2 inches, as examples, although the center hole may be any size including 1.5 inches in diameter or smaller. The center hole of the record is sized to closely fit around a center spindle or post or knob (also referred to herein as an adapter) or a conduit that is produced to be just slightly less in diameter than the diameter of the center hole.

For Long Play (LP) records of the present invention that are produced to play at 33⅓ RPMs and are either 10 inches or 12 inches in diameter, the center hole has a diameter that is different that the center hole in conventional LP albums and is preferably greater than the diameter of the center hole in conventional LP albums (which is approximately 0.286 inches). In particular, in one embodiment, the center hole of an LP album produced according to the present invention is preferably the same diameter as the center hole in a 7 inch record produced according to the present invention so that it closely fits around the same center post, spindle, or adapter used for 7 inch records. In other embodiments, the center hole of an LP produced in accordance with the present invention is approximately 0.286 inches. In other embodiments, the center hole of an LP of the invention is slightly greater than the conventional diameter, such as 5/16 or 3/8 inches. Other hole sizes can be used, including a hole size that is conventional for LP records or one that is smaller than the conventional size.

The present invention includes an on/off button and speaker volume control knob. In particular, in one embodiment of the invention, the post or spindle on which the record is placed (i.e., the center post or spindle that is received through the center hole of the record) is a push on/push off button. That button may also be rotational and serve as a volume control for the speakers. In another embodiment, the center post or spindle is a push-on/push-off button as described and a round component indicative of a 45 RPM adapter is positioned over the button and serves as a rotational knob for speaker volume control. In other embodiments, such as illustrated herein, the spindle is placed through a conduit.

Embodiments of the invention include a round, protective glass cover that has a diameter to cover the record or a slightly greater diameter to cover the record and the faux or real turntable upon which the record is placed. The round glass has a center hole to be placed over the center post or spindle. In one embodiment of the invention, the interior ring that defines the center hole is threaded and threads onto threads on the center post, spindle, or adapter to hold the glass, and thus the record beneath it, securely in place. In other embodiments, the dimension of the center hole of the glass is slightly greater that the post, spindle or adapter onto which it is placed, and a round plastic insert ring having inner threads is clipped into the center hole for use in threading the glass onto the post. In other embodiments of the invention, the component that is indicative of a 45 RPM adapter has a first part comprising a ring that is threaded onto the post and a second, outer rotational knob portion for volume control. Accordingly, the record can be removed and replaced by removal of the outer protective glass which, depending on the embodiment, may require removal of a volume knob and/or ring.

In other embodiments of the invention, the glass is placed over the center hole and thus over the record and a threaded ring (which can be constructed of clear plastic) is then threaded into place over the glass to hold the glass in place. In such an embodiment that is using a 7 inch record with large center hold, the knob assembly that is indicative of a 45 RPM adapter covers the threaded ring so that it is not visible until the knob is removed (such as by pulling the knob off).

In one preferred embodiment, the center post, spindle, or adapter is, as described, both an on/off push button and a rotational volume control. In such embodiments, the center post, spindle, or adapter is itself a knob that has an open end that exposes the mouth of an elongated receptacle that is fitted over a rod or post. In embodiments in which the component that is a 45 RPM adapter or is indicative of a 45 RPM adapter fits over the center post, spindle, or adapter, that component has a center hole that fits snugly onto the knob so that, when the 45 RPM adapter component is rotated (for volume control) the center post or spindle (which actually controls the volume) rotates with it. Preferably, the receptacle of the center post or spindle is keyed/notched to receive the rod in only one orientation.

In accordance with an aspect of the invention, limited edition records are produced. In particular, for example, a music recording of a musical artist that is sold in other formats (such as digitally on CDs or as a file available from online music stores) is cut or pressed on a vinyl record in a selected, limited number in accordance with the principles of the present invention. In embodiments of the present invention, the maximum quantity of a limited edition run is 2,500 copies, although it will be appreciated that other numbers can be used. A limited edition approach may include the advantage of reduced royalty payment and/or administration requirements.

The records produced according to the present invention are preferably formed of vinyl, but can be of any suitable material. Examples of substances that could be used in manufacturing a record of the present invention include, but are not necessarily limited to, vinyl, plastic, glass, rubber, wax, acetate disc, acrylic, wood, one or more metals (such as silver, nickel and copper), etc., or combinations of such materials, such as metal plating on a substrate of another material. The records can be opaque or transparent (such as by using clear acrylic) and in addition to black, can include producing records in white and/or a variety of different colors. The records are cut and pressed using conventional record manufacturing techniques.

In embodiments of the invention, a label (such as a conventional round record label with center hole) is autographed by the artist who recorded the music recording that is cut into the record. The label is pressed into the record during manufacturing of the record. In one embodiment of the invention, each record label of the limited edition run is autographed. In other embodiments, a certain number of record labels are autographed, with the remainder being non-autographed. Each record in a limited edition may be numbered (such as 1/2500; 2/2500 and so on).

In embodiments in which some of the limited edition bear an original autograph with the remainder either bearing a copy of the autograph or not having an autograph present, the label and/or the numbering scheme can be provided with an identifier to further specially designate and distinguish those products having an original autograph. Autograph authentication document, of a type that is known in the signature authentication trade, is included with the product of the invention, such as a certificate of signature authenticity which is itself shaped like a vinyl record and placed in a cardstock or paper sleeve or jacket with album art printed thereon.

In accordance with an aspect of the invention, a writing instrument (such as an ink pen or marker) used by an artist (or artists in a band) to sign a label is then positioned on the face of the speaker housing presenting the record so that the writing instrument is positioned in a manner that is indicative of a stylus on a record player. In particular, a needle that is mounted in a clip is clipped onto a lower end of the writing instrument and the upper end of the writing instrument is placed in a stylus-holding mount that is secured to the face of the speaker housing. In some embodiments of the present invention, such as for example those embodiments in which the invention is an actual record player for playing the record, the stylus holding mount can include conventional rotational elements to enable the stylus to move into and out of position for playing the record.

It is known to etch a serial number or other identifier into the master that it used to press a vinyl record. More recently, a hologram has been etched into the master. According to an aspect of the invention, one or more music artists corresponding to the music recording to be cut or pressed onto the record (i.e., a singer or singers, band members, etc.) etch their names into the master during the production process so that such signature(s) are pressed into each vinyl record produced with the master. Such autographing can take place at signing events which are open to the public and for which tickets can be sold and which can include a concert performance by the signing artist.

In one embodiment of the present invention, each record is manufactured upon receipt of an order, such that inventory of produced records is not maintained. While records could be produced individually upon order, alternatively, orders for records received in a selected time-frame (i.e., all orders in a week) are manufactured in a batch. For example, in the first week of offering a record in a limited edition of 300 records, assume that 37 orders for the record were received. A batch of 37 records are manufactured using the first 37 labels of the limited edition (i.e., 1/300, 2/300, 3/300 . . . etc.).

In accordance with an aspect of the invention, at least a portion of the label pressed into the vinyl record is a hologram.

In accordance with another aspect of the invention, the label includes an NFC (near-field communication) component (which can be integral with the record label or a separate label adhered to the record label) that transmits a unique identifier, such that each record in a limited edition has a unique NFC identifier. An NFC reader (which can include means for generating an electromagnetic field) reads the NFC identifier and stores that information in memory. When the speaker system receives streaming audio, from a source, that comprises the recording that is recording on the record (as identified by an identifier in the streaming audio), an output occurs to indicate that the music recording playing is the (or a) music recording recorded on the record. Such output may be one or more of rotation of the record, information presented on a display to indicate that the music recording being played is a music recording on the record, turning on or changing color or causing flashing of lights.

It should be appreciated that the wireless speaker system and product of the present may be sold with a record already displayed in the product. This record may be a record that is produced by a record label that is associated with (or is the same company as) the provider of the speaker system. It will also be appreciated that customers may wish to present their own record on the speaker (of mounting post sizes permit) and/or purchase additional records (such as the limited edition records described herein) and to build a collection of records and to change the record displayed on the speaker from time to time. In accordance with one aspect of the invention, additional records purchased are provided in a frame with appearance, covered glass, and mounting components as described herein for the speaker system and product so that the record collection can be displayed and that a record from the collection can be easily removed from its display and placed on the speaker system and the record removed from the speaker system can be placed (either in its place) or in its corresponding display frame (which may include markings, photos, or features that identify it as the frame/display for a particular record). In one embodiment of the invention, the speaker is sold with a separate display frame for the record that comes with the speaker. In one embodiment of the invention, the record that comes with the speaker is a real record of an artist (and may be an independent or relatively unknown artist) or is a faux record for display only that can be replaced with a real record of the buyer's choice. The faux record could include a web-address and a coupon code at which a record (such as a limited edition record described herein) can be purchased.

BRIEF DESCRIPTION OF THE DRAWINGS

FIG. 19 illustrates an embodiment of the wireless speaker system of the invention and, particularly, a holder for holding a tablet computing device;

FIG. 19*a* illustrates a holder (which may or may not include a speaker) for holding a tablet computing device including a rotatable, ergonomically designed handle and optional retractable leg portions;

FIGS. 20*a* and 20*b* illustrate a bendable handle portion of a tablet holder of the present invention for use in supporting the holder on a surface;

FIG. 21 illustrates a handle of a holder, for holding a tablet computing device of the present invention, having foldable legs for supporting the holder on a surface;

FIG. 22 illustrates a cover for a tablet computing device having one or rotatable or foldable leg portions for use in supporting the holder on a surface.

DETAILED DESCRIPTION OF THE INVENTION

Figure 1:
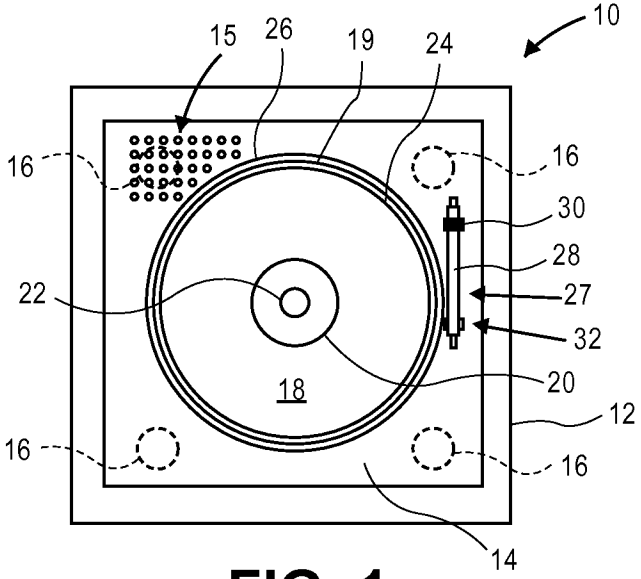
FIG. 1 is a front elevational view of an embodiment the wireless speaker system of the present invention.

With reference initially to FIG. 1, a speaker system of the present invention is denoted generally by reference numeral 10. Speaker system 10 has a frame 12 and a front face 14 having speaker grille or fabric 15. A plurality of speakers (not shown) are mounted in a conventional fashion, such as on a constructed or molded frame, in a housing/cabinet (not shown) so that the speakers are positioned behind the front face at speaker locations 16.

A record 18, such as a vinyl record with a cut groove for reproducing a sound recording, is positioned for display at the front face 14 of the speaker system 10. Record 18 has a periphery 19 and a label 20 that is pressed into the record 18. Record 18 has a center hole that receives a post 22. A faux or real turntable 24 is behind the record 18 (or the record sits on this turntable 24 when the speaker system rests on a flat surface). A round, decorative metal mesh piece 26 has a diameter greater than the diameter of the turntable and is visible at the periphery of the turntable 24. Mesh piece 26 serves as a speaker grille. The invention may employ one or more additional speaker grills or speaker cloth pieces that are layered or adjacent to or separated from mesh piece 26.

The invention includes a faux or real stylus assembly 27 having a stylus 28, a stylus mount 30, and a needle assembly 32. Stylus mount 30 can include conventional rotational components for enabling the stylus to be lifted into and out of position on the record 18. Needle assembly 32 includes a mounting portion for mounting onto the stylus 28 and a record-playing needle (not visible). In accordance with the invention, the stylus 28 is a writing instrument (such as a marker or ink-pen) that has been actually used by an artist to sign an autograph of his or her name, such as an autograph on the label 20.

Figure 2:
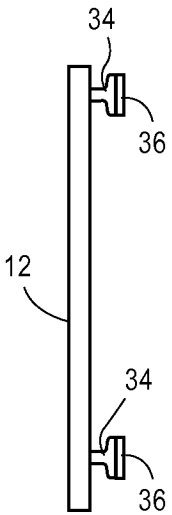
FIG. 2 is a side elevational of the embodiment of the present invention illustrated in FIG. 1.
Figure 3A:
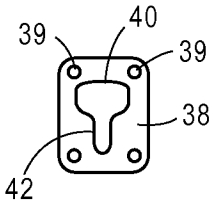
FIG. 3*a* is a front elevational view of a wall mount of the present invention.
Figure 3B:
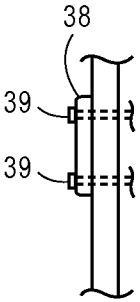
FIG. 3*b* is a side elevational view of the wall mount of the present invention.

With additional reference to FIG. 2, the frame 12 or housing of wireless speaker system 10 includes feet 34 with ridged rubber pads 36. These feet 34 sit on a surface (and the pads 36 provide frictional placement to help prevent the speaker from sliding due to vibration). Alternatively, when speaker system 10 is mounted, such as to a wall or ceiling, these feet 34 are placed into mounts such as mount 38 shown in FIGS. 3*a* and 3*b*. Mount 38 is secured into a wall or ceiling by fasters 39, such as screws or anchors, has an enlarged open area 40 for receiving a foot 36. The system 10 is then moved so that the narrow portion of the foot 34 rests in the smaller open channel 42 and the larger portion of the foot is secured behind the front face of the mount 38. The length of the feet 34 and the depth of the openings in the mount 38 may be such that, when the speaker system 10 is mounted, the rear of system 10 (i.e., its rear face or housing) is flush against the surface to which it is mounted or, alternatively, the length of the feet 34 may be greater than the depth of the mount 38 such that the speaker system 10 is mounted in a slightly spaced fashion from its surface, to thereby allow sound from a rear facing speaker to emit from the sides of the speaker system 10.

Figure 4:
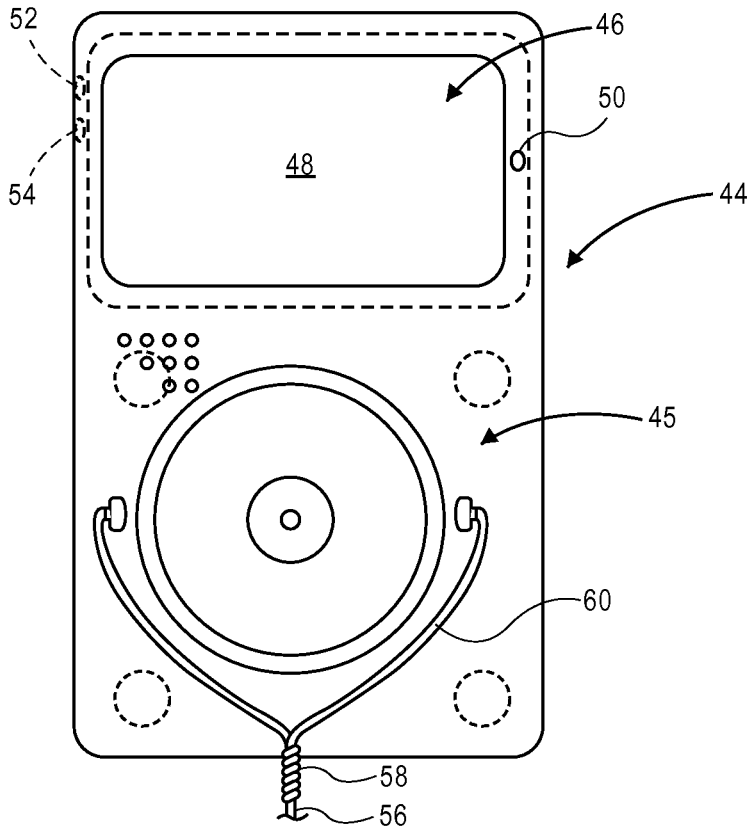
FIG. 4 is a front elevational view of an embodiment of the wireless speaker system of the present invention.

With reference to FIG. 4, another embodiment of the present invention, represented generally by reference numeral 44, is illustrated and described. The embodiment of FIG. 4 is similar in many respects to the embodiment and components illustrated in FIGS. 1-3. Additionally, the wireless speaker system 44 includes a portable electronic device 46, such as a tablet computer, mounted in the housing 45 of wireless speaker system 44 such that a touchscreen/display 48 of portable electronic device 46 is visible and accessible at a face of wireless speaker system 44. A button 50 is also accessible in an opening in the front face of the housing and a button 52 on the tablet computing 46 is accessible via a recessed opening 54 at a side of the housing. The speaker system of the invention may thus serve as a docking station (with connectors for connecting to the speakers by cable) for the tablet computer device 46 and, in embodiments, the tablet computer 46 may be easily removed (such as by removing a cover on the rear of the unit) and re-inserted or replaced. The computing device 46 may be a tablet computer such as those produced under the iPad trademark by Apple, Inc., the Kindle trademark by Amazon, Chrome by Google, Surface by Microsoft, etc. Optionally, earphones or headphones 60 can be included for visual effect and a power cord 56 (connected to a power source, not shown) that enters into the bottom of the housing is bound by a binding 58 with the cord of an earphone (or headphone) 60. Such an arrangement makes a hanging cord (in the case of a wall mount) less unattractive because it has an appearance that is indicative of the dangling earphone cords of many conventional portable digital music players. In this regard, a particular embodiment of speaker system 44 of this embodiment of the invention is a speaker system that has dimensions that are proportional to an iPod® Classic digital music player from Apple, Inc.

Figure 7:
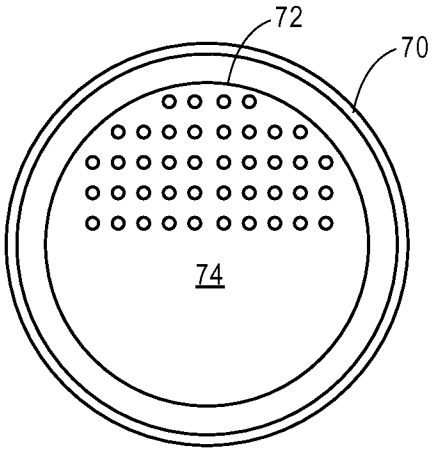
FIG. 7 is a rear elevational view of a component of the embodiment of the present invention illustrated in FIG. 5.
Figure 6:
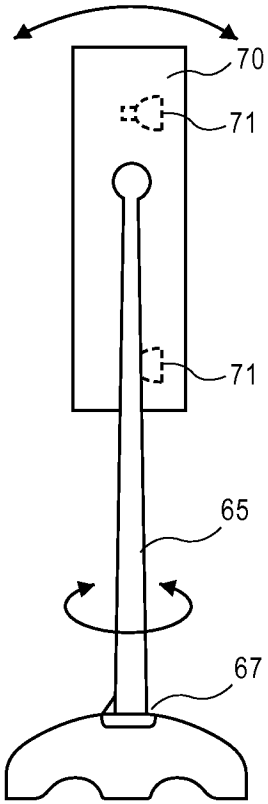
FIG. 6 is a side elevational view of the embodiment of the present invention illustrated in FIG. 5.
Figure 5:
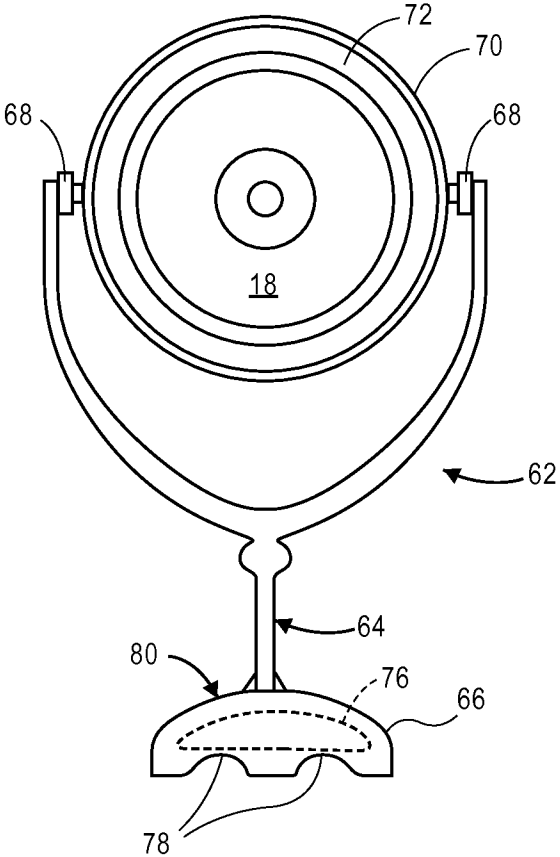
FIG. 5 is a front elevational view of an embodiment of the wireless speaker system of the present invention.

With reference to FIGS. 5-7, another embodiment, represented generally by reference numeral 62, is illustrated and described. The wireless speaker system 62 includes a pedestal mount 64 having a base 66. Pedestal mount 64 rotationally mounts, by mounts 68, the speaker housing 70. One face of speaker housing 70 displays the record 18 and turntable component 24. An outer peripheral transparent or semitransparent area 72 emits light from one or more light bulbs (not shown) located in the housing 70.

The pedestal mount 64 includes hollow portions to enable cords, such as a power cord, to pass through it and into the speaker housing 70 through a central opening in one or both of the mounts 68. As illustrated in FIG. 6, the speaker housing is rotationally mounted by mounts 68 to enable rotation about a horizontal axis an the pedestal stem 65 is rotationally mounted at mount 67 to base 66 to enable rotation about a vertical axis, thereby enabling the user to position components of the speaker system 10 for sound and display in a variety of desired manners.

One or more speaker drivers 71 are mounted in housing 70 and face a face (see FIG. 7) that is opposite the face of the housing which displays the record 18. This opposite face has a speaker grille, fabric or mesh, denoted by reference numeral 74, and also includes a transparent or semitransparent area 72 that emits light from the bulb. The base 66 has a recessed cavity into which a speaker 76 (such as a woofer or subwoofer) is mounted, in one embodiment, in a downward facing manner. The peripheral edge of the base 66 has cut-away portions 78 to enable sound to emit from those areas. Alternatively, the speaker 76 is mounted in an upward facing manner and emits sound through a speaker grille/mesh on the upper face 80 of the base 66.

Figure 8A:
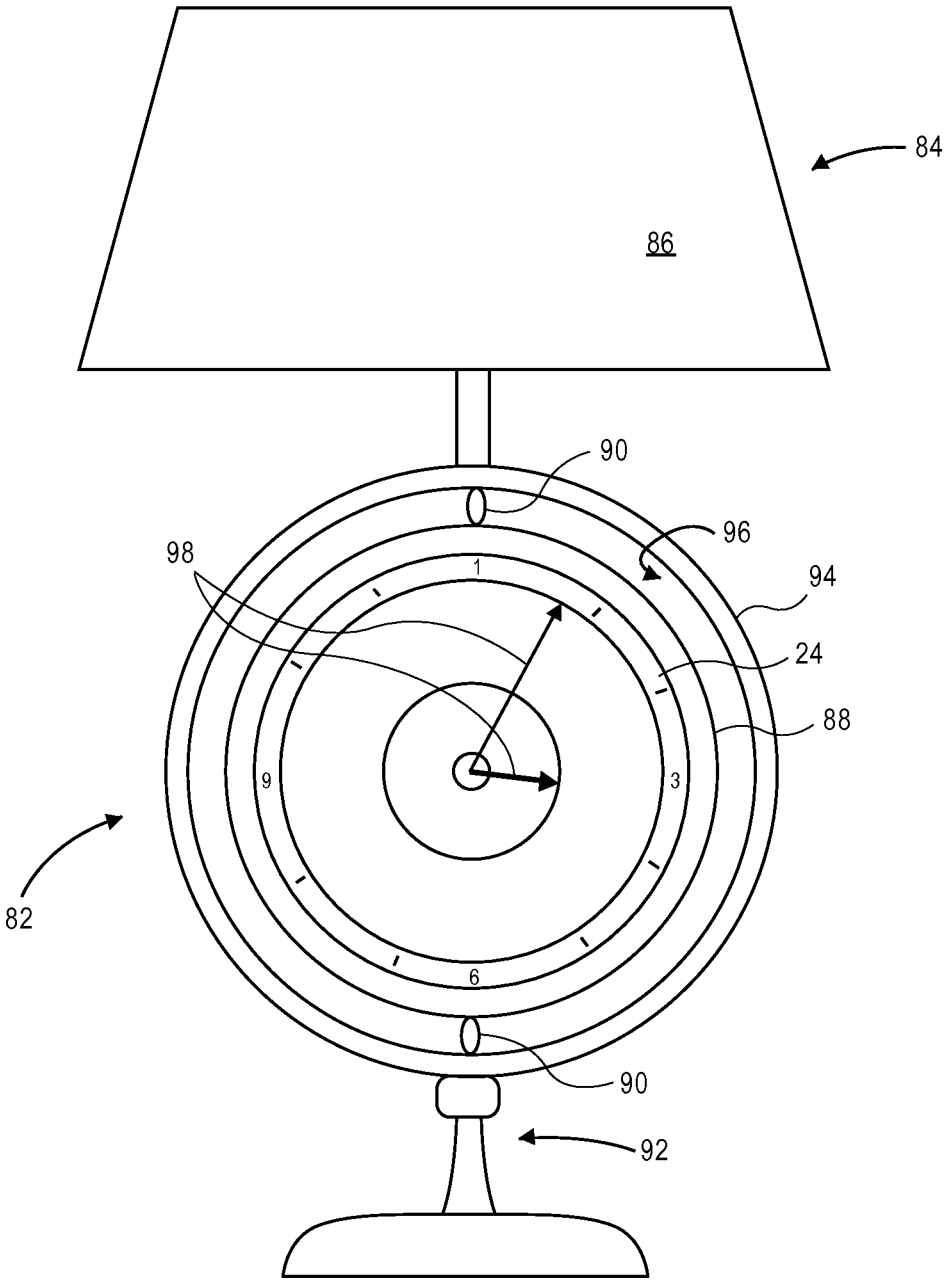
FIGS. 8*a* and 8*b* are front elevational views of embodiment of the wireless speaker system of the present invention.
Figure 8B:
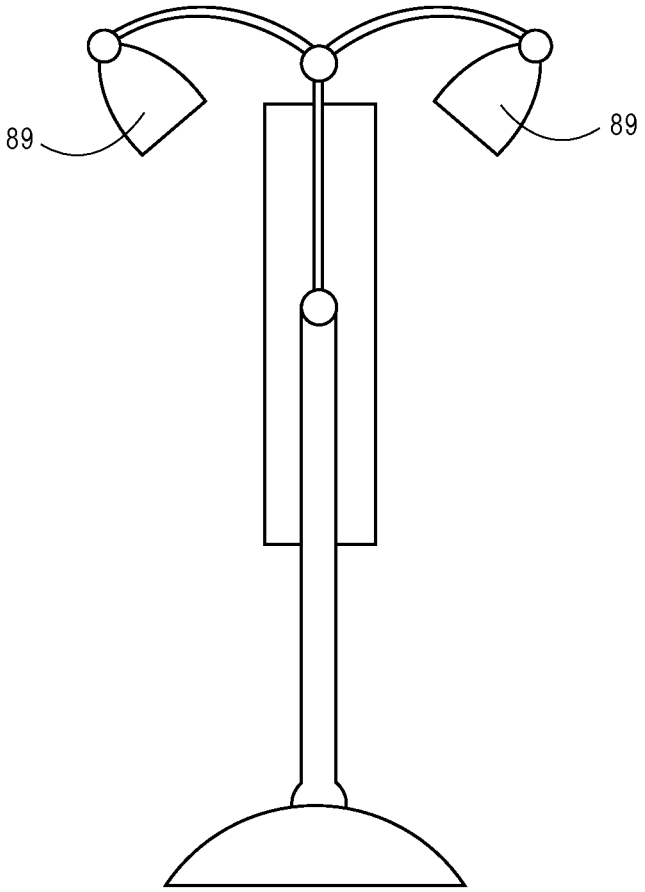

With additional reference to FIGS. 8*a* and 8*b*, an alternate embodiment of the wireless speaker system of the present invention, denoted generally by reference numeral 82, is illustrated. The embodiment of FIG. 8 is similar to the embodiment illustrated and described with respect to FIGS. 5-7, and further includes a lamp assembly, denoted generally by reference numeral 84, and a clock. Lamp assembly 84 includes conventional lamp components such as a lamp shade 86 and light sockets, light bulbs, and an on-off switch (not shown). Lamp shade 86 preferably has a reflective inner surface or layer to reflect light from the lamp bulb onto the record 100. Alternatively or additionally, directionally pointed lamps 89 (FIG. 8*b*) may be employed to shine light onto one or both faces of the housing and, in particular, onto the displayed record 100. The speaker housing 88 may be rotationally mounted as described herein or may be rotationally mounted about mounts 90 so that the housing is rotational about a vertical axis. As illustrated, the lamp pedestal 92 includes a rim 94 and there is space 96 between the rim 94 and the speaker housing 88. A clock (not shown but having clockworks mounted in the housing 88) has clock arms 98 and clock markings (such as numerical time indicators) located on the turntable component 24.

As described, it should be understood that the speakers used in the speaker system of the present invention are loudspeakers and that the system employs a plurality of conventional transducers (speaker drivers) for different audio ranges, including one or more of, and some or all of, subwoofers (very low frequencies), woofers (low frequencies), mid-range speakers (mid-range frequencies), tweeters (high frequencies) and supertweeters, (very high audible frequencies). The speaker components are mounted in a frame that is formed or constructed of any suitable material, including but not limited to wood, plastic, metal, and carbon fiber.

Figure 9:
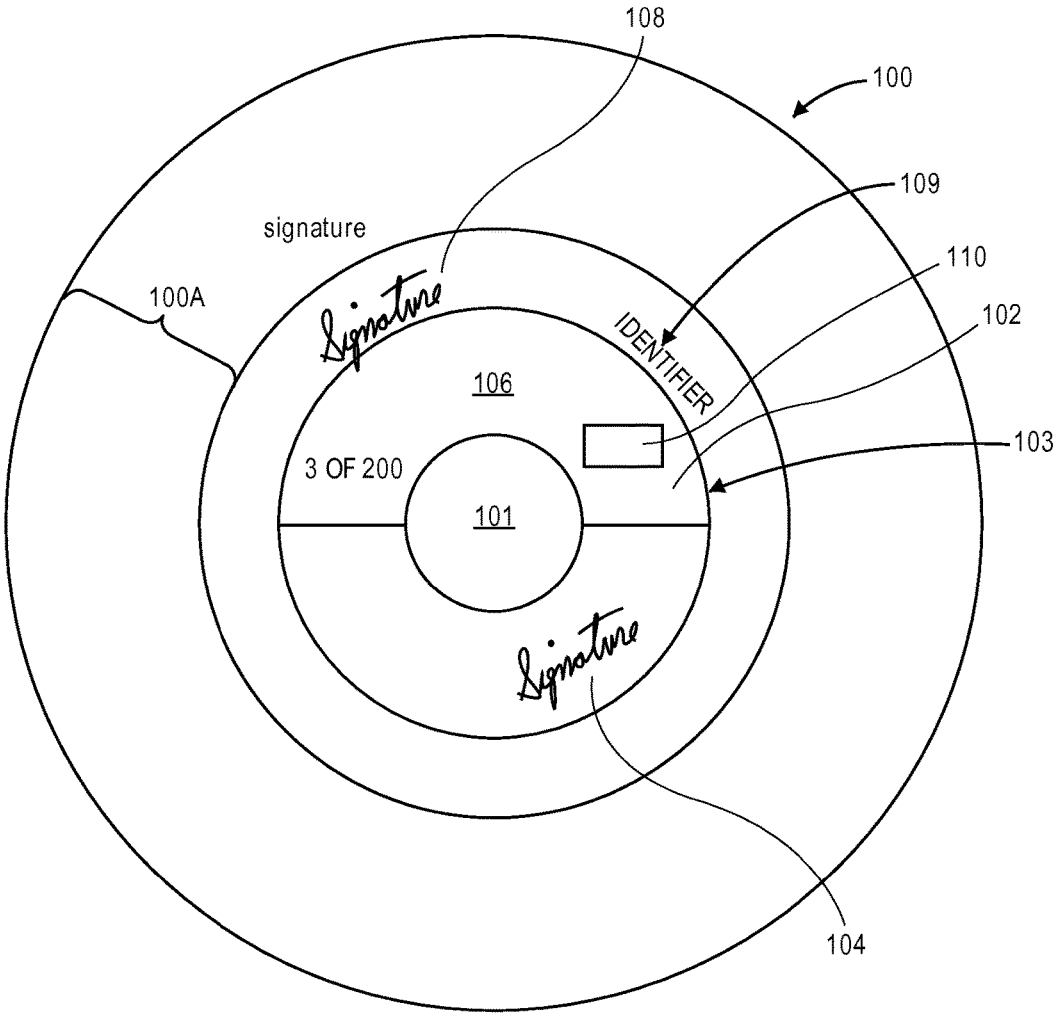
FIG. 9 illustrates a record of the present invention.

With reference to FIG. 9, a record 100 of the present invention is illustrated and described. Record 100 may correspond to the record denoted by reference numeral 12 in the embodiments of the speaker system of the present invention described herein.

Record 100 is preferably made of vinyl, in a conventional fashion, but can be formed from other materials. One or more music recordings are cut into a spiraling continuous groove in the record (located in area 100A) in a conventional record press operation. The source of the music recording may be an analogue recording on tape, for example, or a recording that has been digitally sampled and mastered. While a digital file from which the music recording is sourced may be compressed, such as in an AAC or mp3 format, it is preferred that, if the source of the music recording is a digital file, that it be a digital file that has not been (or been significantly) compressed by a lossy compression algorithm. For example, in one embodiment of the invention, a music recording cut onto the record 100 is sourced from a digital FLAC file. Embodiments of the invention include sourcing a music recording for cutting into a record from digital file containing the music that is at least 65 MB in size and, preferably, greater.

Record 100 has a center hole 101 and a label 102 having a label periphery 103. The center hole may be any desired dimension, but is preferably slightly greater than 1.5 inches (such as 1.6 inches). In accordance with the invention, the record 100 may be one of a limited edition production, a fact that is indicated on the label 102. In one embodiment, limited edition runs include no more than two-thousand five hundred (2,500) pieces. Additionally, the label may be originally autographed (using a writing utensil such as the writing utensil used in stylus 28) by one or more music artists whose recording is on the record, as denoted by signature 104. A portion of label 102, denoted by upper half 106 of the label 102, may be a hologram.

Additionally, record 100 may include an imprinted autograph signature of an artist whose music recording is on the record, as denoted by reference numeral 108. This signature is either a groove or a ridge that is incorporated into the record 100 during pressing. The signature results from a autograph signature that is signed into one of the production components (such as a master or form) used in making record 100. Record making techniques are well known. For example, one traditional record production methodology may include forming a lacquer master which includes the cut grooves containing the music recording. The lacquer master can be plated with metals (such as silver, nickel and copper) to create a metal master (that is pealed from lacquer master). The lacquer master has grooves (is a positive) and may be played. The metal master has ridges in place of the grooves (and is therefore a negative and cannot be played). The metal master is coated with metals to form another part—a metal mold. Like the lacquer master, the metal mold has grooves and is a positive (and can be played). Metal (such as hard nickel) is then applied to the mold to create a final part—a stamper—which is used to press vinyl records.

In accordance with the invention, an artist may sign the lacquer master (creating a groove that becomes a groove in the vinyl record) or may use an electronic pen to etch a signature into the metal master (which then becomes a ridge on the mold, a groove on the stamper, and a ridge on the record) or to etch a signature into the mold (which becomes a ridge on the stamper and a groove on the record) or to etch a signature in the stamper which becomes a ridge in the record). This pressed signature can be the done in a signing event that is open to the public and for which tickets are sold. This signing event can occur as part of or during or at a live music concert performed by the artist. The record also includes a unique identifier pressed into the record in conventional fashion, as noted by reference numeral 109.

The record 100 includes an RFID (Radio Frequency Identification Device) or NFC (Near Field Communication) chip. The NFC chip may be incorporated into label 102 or may comprises a separate label, such as denoted by reference numeral 110. The chip includes an identifier that uniquely corresponds to the record 100 or a music recording (or set of music recordings) recorded on the record 100. The chip is preferably a passive chip that responds to electromagnetic stimulation from a reader device.

Figure 10:
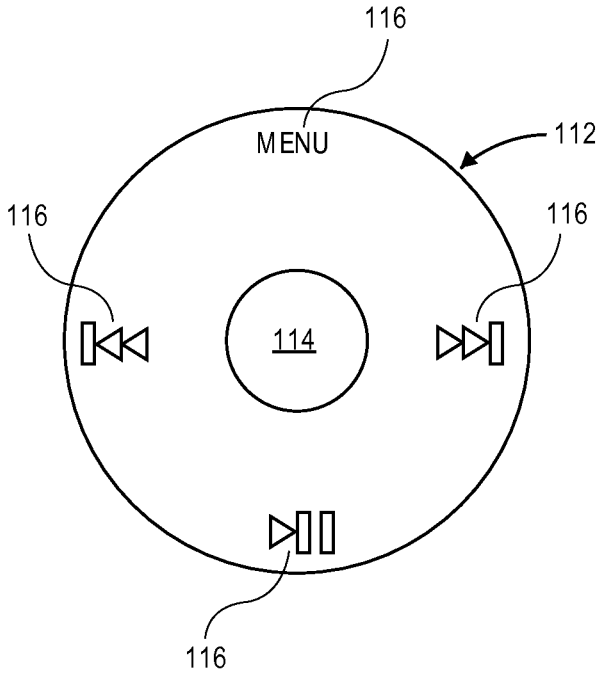
FIG. 10 illustrates touch-input glass according to embodiments of the present invention.

With reference to FIG. 10, a transparent cover 112 for covering the record 100 is illustrated. Cover 112 is preferably made of glass or plastic and may be coated with a variety of coatings to protect from light. Cover 112 has a center hole 114 that is sized to fit over a post or conduit according to the invention. Cover 112 has markings 116 that correspond with music playing control functions. Cover 112 may incorporate touch sensitive input functionality to enable the markings 116 to serve as actual touch input areas for controlling music played by the wireless speaker system of the present invention. Cover 12 may be formed in layers. Cover 12 may include filaments and itself comprise a light bulb that can illuminate.

In embodiments of the invention (not shown), the turntable 24 may have an outer peripheral rim formed of a separate component. The upper edge of the rim extends upwardly or outwardly from the face of the turntable 24 such that the protective cover 112 rests just inside that protruding rim. The rim may incorporate small lamps or LEDs or a light tube positioned so that it provides light in a plane corresponding to the cover. As such, light can emit into the edge of the protective cover providing a unique illumination effect. Additionally or alternatively, small lamps or LEDs or a light tube may be positioned circumferentially about the edge of the hole 114 in the protective cover, such as one the conduit 170 about which the cover is placed, such that light emits at the plane of the cover and into the the cover's edge. This illumination effect can include colors and color changes, such as a change of colors for the output of different songs from the speaker. This lighting can be controlled by one or more inputs on the speaker system.

In embodiments of the invention, the record 110 is formed of transparent or semi-transparent material and the filament and peripheral lighting features described can be applied to the record itself in in addition to or instead of such lighting features at the periphery of the cover 112.

Figure 11:
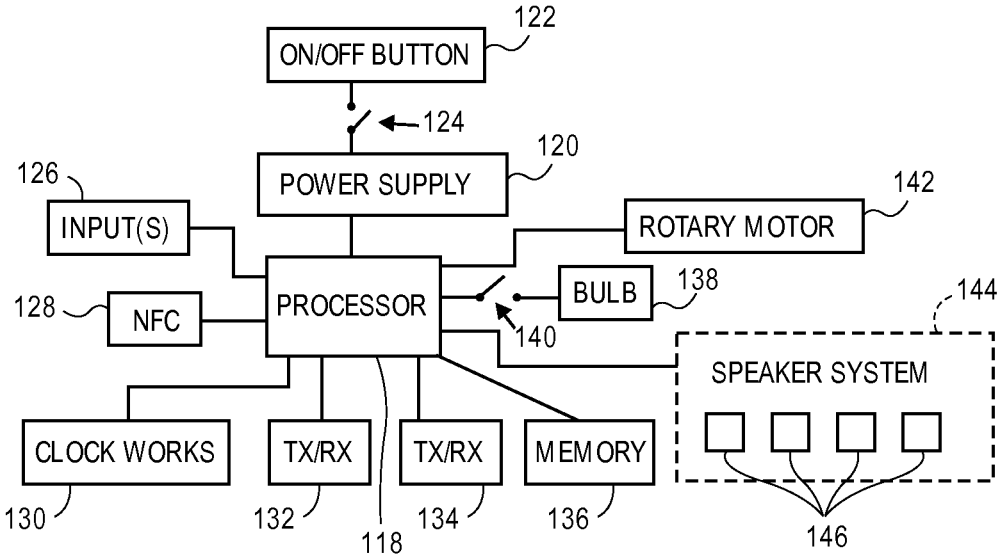
FIG. 11 is a block diagram illustrating electrical components of the present invention.

With reference to FIG. 11, a block diagram illustrates electrical components of the wireless speaker system of the present invention. It will be understood that this block diagram is illustrative, and that multiple different processors, logic circuits and/or electro-mechanical components can be used for performing the functions and achieving the functionality of the present invention.

Embodiments of the present invention include one or more of the following components, which may be connected in the manner shown or in other functional manners—a processor 118, a power supply 120, an on/off button 122 with switch 124, one or more inputs 126, an RFID or NFC reader 128, clockworks 130, a first wireless transceiver 132 (such as a Low Energy Bluetooth transmitter and receiver for use in pairing devices and receiving audio recordings transmitted from another device) and a second wireless transceiver 134 (such as a transmitter and receiver for communicating via a wireless local area network according to a non-proprietary or proprietary protocol), a memory 136, a light bulb 138 with switch 140, a rotary motor 142, and a speaker system 144 having a plurality of speaker drivers 146.

Figure 12:
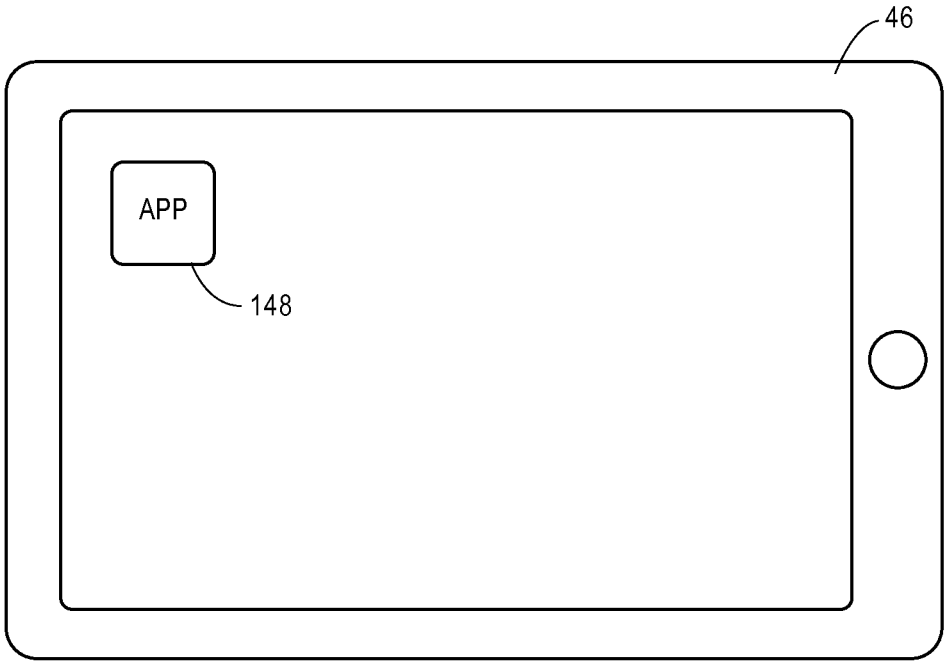
FIG. 12 is a tablet computing device illustrating a mobile application icon according to the principles of the present invention.

With reference to FIG. 12, the present invention includes a mobile software application denoted by icon 148 on the display of a tablet computer, such as tablet computer 46 described herein. The mobile application 148 is installed onto the tablet computer 46 prior to shipping the speaker system to the customer or retail store. The mobile application 148 includes a set of computer executable instructions, including instructions for reversibly disabling a digital media player application in tablet computer 46, instructions for reversibly disabling a media features (such as AirPlay®), and/or instructions for muting speakers in tablet computer 46 so that the tablet computer 46 does not audibly output a wireless music recording received by the speaker system of the present invention. In other words, the audio output of a music recording wirelessly received by the speakers in the speaker system is not competing with sound emitted from the tablet computer 46.

In embodiments of the invention, the wireless receiver, such as wireless receiver 134, receives a wirelessly transmitted music recording from a source and the speaker system of the invention audibly outputs that music recording via the speakers. The tablet computer 46, which may have functionality to also receive the wirelessly transmitted music recording, is either disabled to receive the music recording or receives it but does not audibly output it (although it may output information or video relating to the music recording on its display).

In other embodiments of the invention which incorporate a mobile device such as tablet computer 46, the tablet computer 46 receives the music recording and then outputs it to the speakers in the housing of the present invention. Thus, the internal processing components of the tablet are used to play and output the music to the speakers, making it unnecessary to include additional separate components, such as a processor, transceivers, etc. of FIG. 11. Indeed, the speaker system of the present invention may serve as a docking station for the tablet computer and include a connector for connecting the tablet computer to the speaker system by cable.

In embodiments of the invention, the tablet computer 46, mounted in the housing of the speaker system of the present invention, is the source of digital music (which may be receiving the music from a remote source) or have it stored internally. The tablet computer 46 may be connected by cable to the speakers of the present invention or may wirelessly transmit music recordings to the speaker system of the present invention, such as by a wireless local area network or Low Energy Bluetooth.

Figure 13:
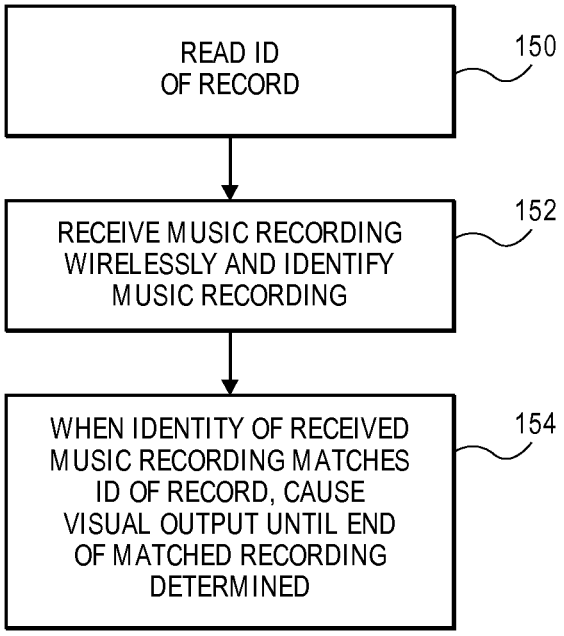
FIG. 13 is a flow chart illustrating a method that is carried out by computer software having instructions that are executing by an electronic processor according to the principles of the present invention.

With reference to FIG. 13, a computer software flowchart is illustrated and described. At step 150, the NFC reader 128 generates an electromagnetic field and reads a response from NFC tag 110 on the record and uses the response, such as by comparing a received identifier with a database of songs, to identify a song or a plurality of songs on the record 100. At step 152, the speaker system of the present invention wirelessly receives a music recording from a music source (such as wirelessly receiving a music recording via Low Energy Bluetooth receiver 132 or wireless local area network receiver 134) having an identifier transmitted with the music recording. The identifier is used to identify the received music recording, such as by matching the identifier of the wirelessly received music recording with an identifier of that music recording in a database of music recordings. As indicated at step 154, when a computer-implemented determination is made that the identity of the received music recording matches the identity of a music recording on the record, a visual output is generated. Examples of such visual outputs include one or more of turning on or off a lamp, changing (i.e., increasing or dimming) the intensity of a lamp, displaying information on a display (including, when applicable, the display of a tablet computer employed in the speaker system), and/or turning a turntable component.

Figure 14:
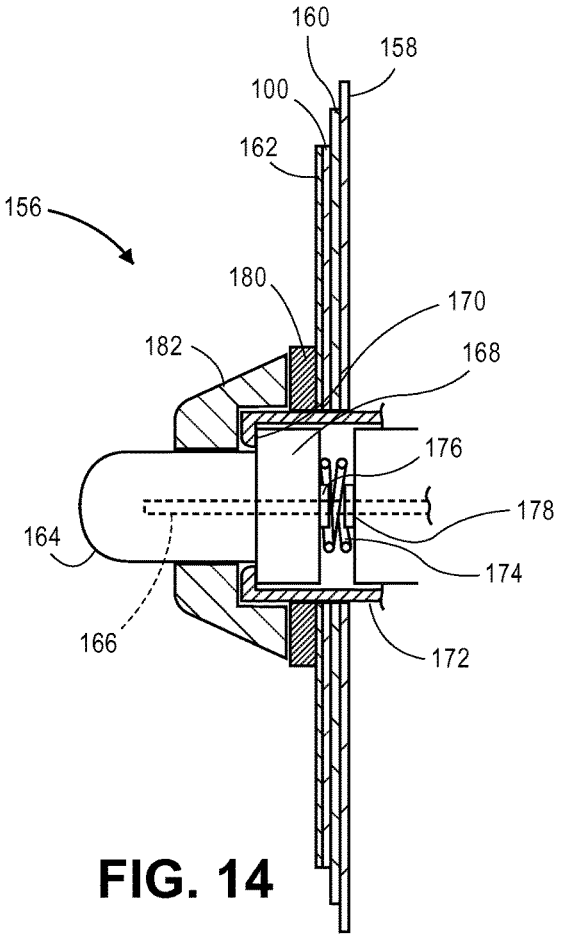
FIG. 14 is a cross-sectional view of an on-off switch and volume control inputs of the present invention.

With reference to FIG. 14, a button and knob assembly of the present invention is denoted generally by reference numeral 156. Illustrated are a first speaker grill 158, which may correspond to the decorative metal mesh piece 26 illustrated in FIG. 1 (the invention may employ additional speaker grills or cloths in a layered or non-layered arrangement), a turntable component 160, record 100, and a protective transparent cover 162. Turntable 160 may be a faux turntable for displaying record 100 and include, for example, a rubber or felt outer surface, or may be an operational turntable. Other components, not shown, including conventional turntable components may be used, such as a spacer (which may rotate) between the turntable 160 and the speaker grill 158, etc).

A spindle 164 is attached to a post 166. Together, spindle 164 and post 166 serve as a push on-push off power button for the speaker system of the present invention. In one embodiment, spindle 164 snugly fits over post 166 in only one orientation due to the shape of the post 166 and a corresponding channel in the spindle 164. Spindle 164 may, with sufficient force, be pulled off of post 166. In another embodiment, spindle 164 includes a base portion 168 that keeps spindle 164 retained (by rim 170 of a conduit 172) in the speaker system. On/off push buttons are well known. As illustrated, one embodiment of button and knob assembly 156 includes a spring 174 and electrical switch contacts 176, 178 for use in turning the speaker system on and off, alternatively, with presses of the spindle 164.

Spindle 164 may be formed of any suitable material, such as metal or plastic or glass. In one embodiment, spindle 164 is transparent or semi-transparent and a lamp (or LED, not shown) is positioned such that the spindle appears to illuminate when the speaker system is on or when the speaker system is outputting a music recording that corresponds to a music recording on the record 100. In one example, the spindle illuminates in a first color to indicate that the speaker system is "on" and illuminates in a second color to indicate that the speaker system is outputting a music recording that is recorded on record 100.

As illustrated, protective transparent cover 162 and record 100 are removably held in place by a threaded ring 180 that threads onto the outer periphery of conduit 172. A knob 182, which can be indicative of a 45 RPM adaptor component, is placed over the spindle 164 and conduit 172 as shown. As will be appreciated, the record 100 can be removed by removing knob 182, threaded ring 180, protective transparent cover 162, and then the record 100. The record 100, or another record, can be replaced by reversing that method.

In embodiments of the invention, the spindle 164/post 166 also comprises a rotary knob for controlling the volume of the speakers of the speaker system of the present invention. The spindle 164 may be rotated directly—or the knob 182, which is snugly fitted over the spindle, may be rotated causing the spindle to rotate with it. On/off push buttons that also function as rotary volume controls are known to those with skill in the art of radios and such arrangements are found on many automobile radios. However, to applicants knowledge, it is not heretofore known to provide an on/off and volume control button that functions as and/or is indicative of a record player spindle or a record player spindle and 45 RPM adaptor and that is used to control power and volume in a wireless speaker system.

Figure 15:
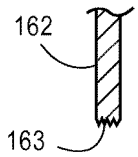
FIG. 15 illustrates a threaded glass of the present invention.
Figure 16:
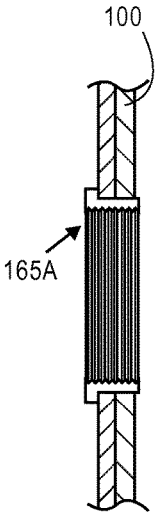
FIG. 16 illustrates an embodiment of a threaded insert of the present invention.
Figure 17:
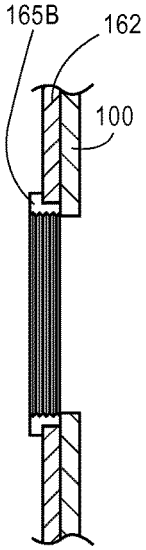
FIG. 17 illustrates another embodiment of a threaded insert of the present invention.

With reference to FIG. 15, the inner peripheral rim of the opening in the protective cover 162 may be threaded, as denoted by reference numeral 163. FIGS. 16 and 17 illustrate different embodiments of a threaded plastic or metal clip ring 165*a*, 165*b*, respectively, that compression fits or snaps into place in the opening of the protective cover 162 and/or the record 100. Threaded clip rings 165*a* and 165*b* thread onto the conduit 170.

Figure 18:
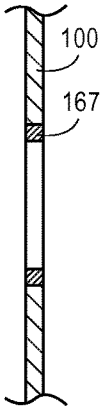
FIG. 18 illustrates an insert of the present invention.

FIG. 18 shows a ring insert 167 positioned in a record 100 of the present invention that has a greater than standard sized central opening. This ring insert 167 enables the record to fit over a conventionally sized adaptor or spindle and enables the speaker system to display a user's own records, while further distinguishing a unique limited edition record of the present invention.

With reference to FIGS. 19-22, a variety of holder devices of the present invention, for holding a tablet computer, are illustrated and described. Such holders, denoted generally by reference numeral 184 in FIG. 19, may be formed of any suitable material, such as plastic, metal, carbon fiber, etc. and may include a speaker 186. A tablet computer having a display may be removably inserted into the holder 184 (such as at a slot in one side or in other manners (i.e., opening a portion of the periphery and snapping back shut to hold the tablet computer). Such a holder is particularly useful when mirroring content from another device (such as a television). In FIG. 19*a*, the handle 188 is angled for ergonomic comfort in holding and may be frictionally (or click-step) rotated to enable the user to easily switch hands in holding the holder 184. As illustrated in FIGS. 19*a*-21, the handle 188 may include one or more additional leg portions 190 that fold down to enable the holder to rest upright on a surface. The leg portions 190 can be rotated back into a tucked position. The handle may include enlarged feet portion 192 and may be bendable or include rotatable sections (as illustrated in FIG. 20*b*) to enable the handle to rest on a surface. FIG. 22 illustrates a cover 194 with folding sections for covering a tablet computer. At least one foldable portion 196 includes a leg portion 198 that can be folded from a tucked position to serve as a handle for hand-holding the tablet computer.

Figure 23:
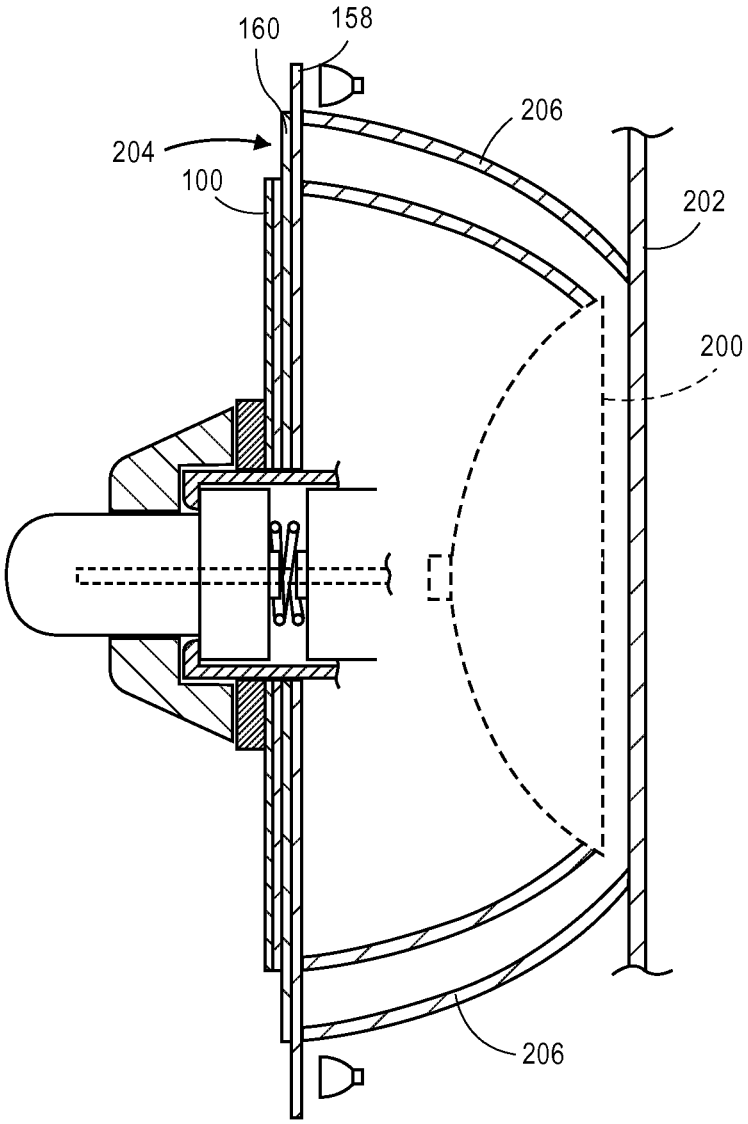
FIG. 23 illustrates a sound wave guide of the present invention.

With reference to FIG. 23, a wave guide of the present invention is illustrated and described. A speaker driver 200, which may be any desired speaker driver and could, for example, be a woofer or subwoofer, is mounted in the speaker housing of the present invention in a rearward (or downward) facing manner. The speaker emits sound against a rear wall 202 of the speaker housing (or in some embodiments directly against a surface upon which the speaker system is mounted or is resting). Sound waves emitted from speaker driver 200 are guided to a front face 204 of the speaker system by wave guide 206 (which are shown in partial cross-section but which form a circumferential bowl-shape). The wave guide 206 channels sound waves from speaker driver 200 out through the speaker grill 158 at a location that surrounds the periphery of the turntable component 160 (or the record 100 if a turntable component is not used; or the turntable component could itself be made of speaker cloth, grill, or mesh and the wave guides could channel the sound out through that component). In particular, the wave guide 206 channels sound from speaker driver 200 out of the speaker housing at a circumferential rim that is in close proximity to the periphery of the record 100. It will be appreciated that such a wave guide can be used to channel sound on a speaker that is facing a different direction, such as forward facing.

Operation of the present invention will be understood from the description and specification herein. The wireless speaker system of the present invention is detected by a digital media player (such as using wi-fi or Bluetooth or other wireless pairing technologies), such as a home entertainment unit or a mobile device that is a source of digital media recordings and is enabled to wirelessly transmit a digital music recording. Once detected, the speaker system is ready to wirelessly receive music recordings that are transmitted from the source of music recordings. A received audio recording is output via the speaker drivers. The speaker system visibly outputs an output as described herein when the received music recording matches a music recording that is recorded on the record displayed by the speaker system (as identified by the speaker system using the NFC reader and the NFC label/tag on the record).

In embodiments the invention is a lamp, such as floor standing lamp, having, in addition to at least one speaker component in a housing mounted to the lamp pedestal, one or more additional components mounted to the pedestal. Such components could include (and could be dimensionally identical to or similar to the speaker housing) a mirror, a clock, artwork, or a light (such as a directional stage light). In embodiments, such components are rotationally and removably mounted to the pedestal. Any wiring or power chords for such components are extended through the pedestal. In embodiments, such components include a quick connection socket and chords include a quick connector for simplifying the connection and mounting process. These embodiments enable the user to customize the appearance of the combination lamp/wireless speaker according to a user's taste and decorative style for his or for home or office.

For example, one preferred embodiment of the invention is a floor standing lamp and speaker system of the present invention that has a base for engaging the floor in which an amplifier (such as a D-type amplifier) is mounted. Just above the first base is a speaker housing for housing a subwoofer. This subwoofer housing may open downwardly with feet portion engaging the base or may open outwardly and be rotationally mounted to a pedestal extending upwardly from the base. Multiple additional speaker housings (such as two) are rotationally mounted to the pedestal (which extends upwardly from the base or from the subwoofer housing) with one speaker housing being located higher on the pedestal than the other. An additional component (such as a record display, mirror, clock, or light) is removably mounted still further above the pedestal. A lamp assembly including lamp bulb socket, lamp bulb, and lamp shade are mounted to the pedestal above the upper, additional component.

It should be understood that embodiments of the invention may utilize wireless speakers or speakers that receive audio signals by a cable. It should be understood that many embodiments of the present invention are possible and that the foregoing is illustrative and should not be construed in a limiting sense. It should be understood that certain features and/or components of the present invention may be used alone or in combination with other features/components of the present invention.

It should be understood that certain features and subcombinations are of utility without reference to other features or subcombinations. This is contemplated by and is within the scope of the claims.

What is claimed is:

1. A device comprising:

a table or floor lamp comprising a base and a pedestal extending upward from the base, wherein said pedestal comprises a rigid structure, wherein said rigid structure comprises an upwardly oriented rim, frame, or bracket;

a removable speaker assembly, wherein said removable speaker assembly comprises a receiver for receiving wirelessly transmitted signals, a speaker, and a speaker housing for housing said receiver and said speaker, wherein said speaker assembly is mounted to said upwardly oriented rim, frame, or bracket at a location that is spatially removed from and above said base;

at least one of a lamp socket and a light supported by said pedestal at a location that is above said speaker housing when said removable speaker assembly is located on said device;

a power chord having a plug for plugging into an A/C power source for providing power to said at least one of a lamp socket and light and said removable speaker assembly; and a connector for connecting to and disconnecting from said removable speaker assembly, wherein said connector provides power to said removable speaker assembly when said plug of said power chord is plugged into an A/C power source and said connector is connected to the removable speaker assembly, wherein, when said removable speaker assembly is located on said device and is connected to said connector, at least a portion of said rim, frame, or bracket is disposed around at least a portion of said housing of said removable speaker assembly such that (i) there is a gap between at least a portion of said rim, frame, or bracket and said housing of said speaker assembly, wherein said gap comprises a visible open space and (ii) an upper portion of said rim, frame, or bracket is above said removable speaker assembly.

2. The device of claim 1, further comprising a lampshade for positioning over said at least one of a lamp socket and light.

3. The device of claim 1, wherein said removable speaker assembly has a housing having a face, said device further comprising a record, having a music recording cut in at least one groove on said record, positioned for visible display at said face of said housing.

4. The device of claim 1, wherein said speaker comprises a first speaker and said device further comprising a second speaker located in said base.

5. The device of claim 1, wherein said device comprises a floor standing lamp, wherein said removable speaker assembly comprises a first removable speaker assembly, said device further comprising a second removable speaker assembly mounted on said pedestal at a location that is at least substantially vertically displaced from said first removable speaker assembly.

6. The device of claim 1, further comprising an amplifier located in said base and connected to said removable speaker assembly by at least one cable extending inside said pedestal between said removable speaker assembly and said amplifier.

7. The device of claim 1, wherein said speaker comprises a first speaker and said device further comprising a second speaker located in said base.

* * * * *